US006293178B1

(12) United States Patent
See

(10) Patent No.: US 6,293,178 B1
(45) Date of Patent: Sep. 25, 2001

(54) PYROTECHNIC LAUNCH TUBE

(75) Inventor: Samuel A. See, Goodrich, TX (US)

(73) Assignee: Champion Fiberglass, Inc., Spring, TX (US)

( * ) Notice: Subject to any disclaimer, the term of this patent is extended or adjusted under 35 U.S.C. 154(b) by 0 days.

(21) Appl. No.: 09/419,839

(22) Filed: Oct. 15, 1999

(51) Int. Cl.[7] ..... F41A 21/00
(52) U.S. Cl. ..... 89/16
(58) Field of Search ..... 89/16, 1.81; 124/59, 124/48; 102/361, 49.7, 323, 333, 335; 493/48, 308; 264/46.8, 101, 36.15, 45.5

(56) References Cited

U.S. PATENT DOCUMENTS 1,922,081 * 8/1933 Driggs .
3,068,756 * 12/1962 Schermuly .
4,733,597 * 3/1988 Upham .
4,791,870 * 12/1988 Simpson .
5,076,134 * 12/1991 Marshall et al. .
5,109,750 * 5/1992 Kayaian .
5,149,290 * 9/1992 Reveen .
5,623,113 * 4/1997 Valembois .
5,803,791 * 9/1998 Chiles .

* cited by examiner

*Primary Examiner*—Charles T. Jordan
*Assistant Examiner*—T L. Chambers
(74) *Attorney, Agent, or Firm*—Akin, Gump, Strauss, Hauer & Feld, L.L.P.

(57) ABSTRACT

A pyrotechnic launch tube made using fiberglass reinforced polymer (FRP) includes a cylindrical FRP tube having an inside wall, where the inside wall has a circumferential groove near a lower end of the tube. A bottom member made of FRP is molded for engagement with the tube at the groove. After forming the tube and the groove, a mold having a concave surface is placed inside the tube adjacent to the groove, and resin-coated fiberglass matting is laid on the mold. A fibrous material is placed over the fiberglass matting and a nonporous bag seals the fiberglass matting. A vacuum is drawn in the bag, and atmospheric air pressure compresses the fiberglass matting, forcing it into the groove. A counter mold can be used instead of vacuum setting to compress the fiberglass matting. The bottom member has a convex surface, and the convex surface and the inside wall of the tube define a chamber for receiving pyrotechnics.

20 Claims, 1 Drawing Sheet

PYROTECHNIC LAUNCH TUBE

CROSS-REFERENCE TO RELATED APPLICATIONS

Not applicable.

STATEMENT REGARDING FEDERALLY SPONSORED RESEARCH

Not applicable.

BACKGROUND OF THE INVENTION

1. Field of the Invention

This invention pertains to pyrotechnic launch tubes, and particularly to a pyrotechnic launch tube made using fiberglass reinforced polymer.

2. Description of the Related Art

A fiberglass reinforced polymer (FRP) pyrotechnic launch tube has been made, where a bottom is formed by bonding or gluing a plug inside the tube. However, the force from the explosion of pyrotechnics inside the tube can break the adhesive bond between the bottom and the inside wall of the tube. The pyrotechnic launch tube must then be repaired or replaced.

SUMMARY OF THE INVENTION

A method has been devised for making a fiberglass reinforced polymer (FRP) pyrotechnic launch tube that can better withstand the explosive force of the pyrotechnics. An FRP tube is made, and a groove is formed about an inner circumference of the tube near one end. A bottom piece is engaged with the groove so that axial forces during the explosion of the pyrotechnics are transmitted to the tube. Thus, rather than relying on the bond strength of an adhesive to hold a plug in the bottom, the bottom piece is instead engaged with the FRP tube by its protrusion into the circumferential groove.

The pyrotechnic launch tube may be formed by providing a mold inside the launch tube adjacent the groove and molding FRP to form the bottom. A fiberglass mat and resin can be laid on the mold and compressed or vacuum set to squeeze the fiberglass and resin into the groove and to saturate the mat with resin. Alternatively, a bottom can be pressed into the tube, where the bottom initially compresses and then expands into the groove. The bottom and the tube form a chamber for receiving pyrotechnics, and the bottom preferably has a convex surface for defining the chamber. In this manner, explosive forces press the bottom into tighter or deeper engagement with the tube at the groove.

A pyrotechnic launch tube made according to such methods is thus better able to withstand the explosive forces as pyrotechnics are discharged from the tube.

DETAILED DESCRIPTION OF INVENTION

Figure 1:
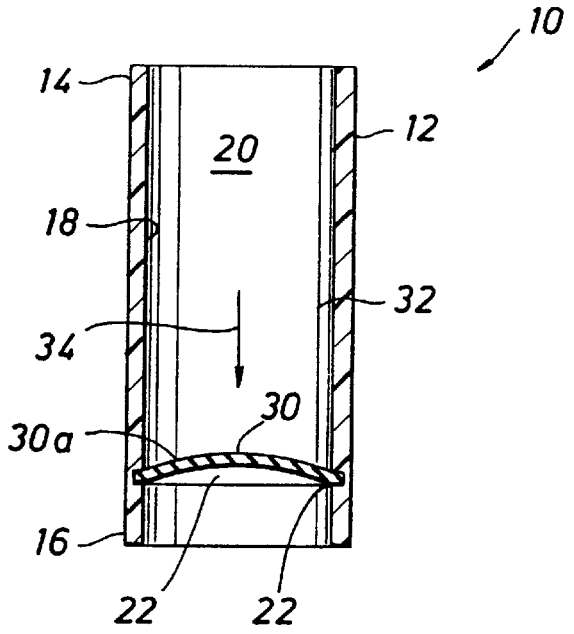
FIG. 1 is a cross section of a pyrotechnic launch tube, according to the present invention.

FIG. 1 shows a fiberglass reinforced polymer (FRP) pyrotechnic launch tube 10 in cross section according to the present invention. Launch tube 10 comprises a cylindrical tube 12, which is formed by conventional means of wrapping resin-coated strands of fiberglass around a mandrel; curing the resin; and removing the mandrel. Tube 12 has an upper end 14, a lower end 16 and an inside wall 18. Inside wall 18 has a cylindrical surface 20. A groove 22 is formed in inner wall 18 near lower end 16.

Groove 22 is illustrated as formed within a circumference of tube 12 evenly spaced from lower end 16, but could be formed such that it is unevenly spaced from lower end 16 if desired. Groove 22 can be cut into inside wall 18 or can be formed concurrently with the formation of tube 12. Groove 22 is preferably, but not necessarily, continuous, as it could be a series of discontinuous slots.

A bottom member 30 is engaged in groove 22. In one embodiment, bottom member 30 is a flexible disc having a diameter greater than that of inside wall 18, where the bottom is pushed and flexed to slide along surface 20 until it reaches groove 22 and expands into groove 22.

Bottom member 30 is illustrated as having a convex surface 30*a*, which may have an irregular shape, a conical shape or, as illustrated, a hemispherical or dome shape. In the embodiment illustrated in FIG. 1, a chamber 32 is defined by cylindrical surface 20 of inside wall 18 and surface 30*a* of bottom member 30.

In use, pyrotechnics are received in chamber 32. When the pyrotechnics are ignited or discharged, explosive force pushes down on bottom member 30 in the direction illustrated by arrow 34. If bottom member 30 is provided with a dome shape, as illustrated, the explosive force tends to flatten bottom member 30, which presses it into further and deeper engagement with groove 22. Thus, the explosive force is transmitted efficiently and effectively to tube 12. Since tube 12 is made of a strong fiberglass reinforced polymeric material, it contains the explosive force quite readily.

Other shapes can be used for bottom member 30, such as one having a convex surface and a hooked outer edge for engagement with tube 12 at groove 22, which can have a mating interlocking shape. This construction is more difficult and costly to make, but it provides interlocking engagement between bottom 30 and tube 12, which is one aspect of the present invention.

In the past, a flat plug has been bonded by an adhesive to an interior wall of an FRP tube to make a pyrotechnic launch tube. However, the bond between the plug and the interior wall tends to break during discharge of pyrotechnics. Further, where an FRP plug is made in place and cured inside the tube, where the tube does not have a groove for receiving the plug, the FRP plug shrinks during curing, which tends to break the bond between the plug and the interior wall of the tube. Shrinkage is accommodated by the present invention within the depth of groove 22, where bottom 30 continues to engage tube 12 after curing and shrinking slightly.

One end of a tube could be enclosed during formation of the tube, but this has historically been cost prohibitive. However, it is technically feasible, and the resulting bottom could have a concave surface for defining the interior chamber. In this case an outer sleeve could be placed about the tube to provide a squared-off end so that the tube can be easily placed in an upright position for discharge of pyrotechnics.

Figure 2:
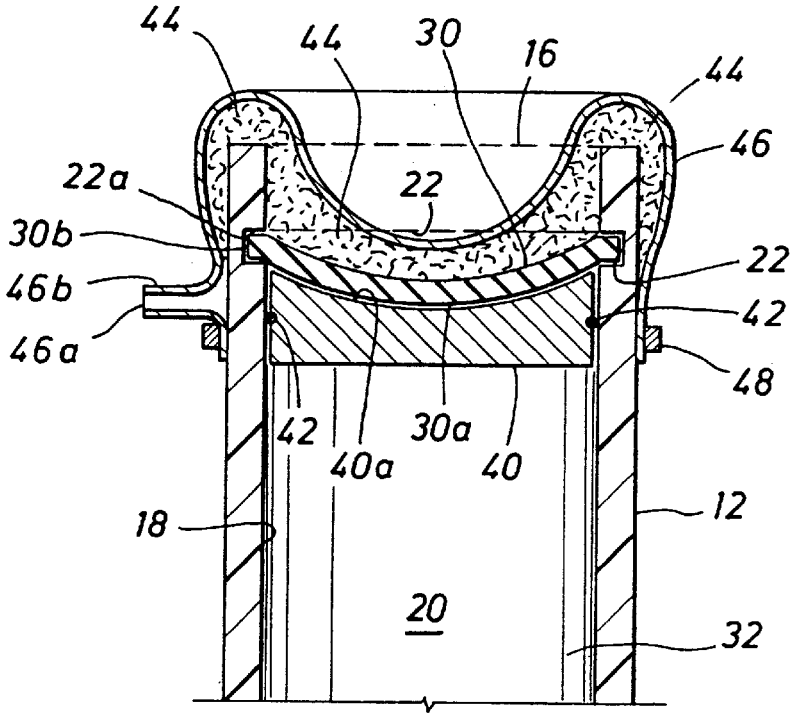
FIG. 2 is a cross section illustrating a method of making a launch tube according to the present invention.

Turning now to FIG. 2, a method and apparatus for making an FRP launch tube 10 is illustrated. Tube 12 has been turned upside down, and lower end 16 is now in an uppermost position. A mold 40 having a concave surface 40*a* is placed inside tube 12 adjacent to groove 22. Mold 40 is preferably sealed with inside wall 18 of tube 12, such as by an O-ring 42. A release agent is coated on mold 40 so that mold 40 can be subsequently removed.

Resin-coated fiberglass matting is built up to a desired thickness on mold 40. Fibers can be laid in a desirable orientation, such as a cross hatch, and pressed into groove 22. When a desired thickness is built up, a porous sheeting having the texture of a wax-coated nylon can be laid on the fiberglass matting. This layer is not shown in FIG. 2 in order to simplify the drawing. A porous and fibrous material 44 is next placed over the fiberglass mat in lower end 16 of tube 12.

A nonporous sheet 46 is placed over fibrous material 44, and a clamp 48 compresses nonporous sheet 46 against tube 12, which seals the fiberglass matting within the lower end 16 of tube 12. The fiberglass matting is thus sandwiched between mold 40 and porous material 44. Nonporous sheet 46 has an opening 46*a* and a tubular connection 46*b* for connection to a vacuum source (not shown).

The vacuum source, the equivalent of a vacuum cleaner, a vacuum pump, an aspirator or other suitable means, is connected to tubular connection 46*b*. A vacuum is drawn, which evacuates air, vapor and gas from the fiberglass matting and from the porous material 44. Atmospheric pressure on the outside surface of nonporous sheet 46 compresses fibrous material 44 and the fiberglass matting, which causes the fiberglass matting to extrude into groove 22. Fibrous material 44 is selected for allowing air, gas and/or vapor to pass out of the fiberglass matting and to the vacuum source through opening 46*a*. Fibrous material 44 may be a felt, an insulation or any other suitable material that allows air, gas and vapor to pass therethrough.

Nonporous sheet 46 thus forms a bag over lower end 16 of tube 12. A clamp 48 seals nonporous sheet 46 to an outer surface of tube 12. Clamp 48 may be an adhesive tape, mastic, a Velcro® strap, a belt, a pipe clamp or any suitable mechanism. O-ring 42 provides a seal between mold 40 and inside wall 18 of tube 12 as a vacuum is drawn through opening 46*a*.

Outside air pressure compresses the fiberglass matting and tends to provide a uniform thickness of the fiberglass matting as well as engagement of the matting within groove 22. Alternatively, a mold could be provided from lower end 16, and air pressure could be provided from upper end 14. In fact, tube 12 could be sealed at upper end 14, and pressure higher than atmospheric pressure could be used. Various shapes of the mold can be used to provide a bottom member of any desired shape and configuration. Although the fiberglass matting may shrink some during curing, bottom 30 continues to be engaged with tube 12 at groove 22. The depth of groove 22 thus provides room for contraction of the fiberglass matting as it cures.

Nonporous sheet 46 and clamp 48 are removed and the fiberglass matting is allowed to cure to form bottom member 30. The rate of curing can he accelerated by heat, such as by placing the fiberglass matting under a heat lamp. Thus, bottom member 30 is molded in place for engagement with tube 12 at groove 22 through an interlocking arrangement.

Turning tube 12 right side up, bottom member 30 and lower end 16 are in a lowermost position. Pyrotechnics can then be loaded in chamber 32 for subsequent discharge. A pyrotechnic launch tube is thus made of fiberglass reinforced polymeric material, where the bottom is molded in place and engaged with the inside wall of launch tube 12. A watertight seal can be provided by bottom 30, which prolongs the life of unused pyrotechnics contained within chamber 32.

In another embodiment, a counter mold (not shown) and pressure are used to compress the resin-coated fiberglass matting rather than the vacuum-setting process described above. The counter mold preferably has a convex surface that corresponds in shape and size to the concave surface 40*a* of mold 40, and the resin-coated fiberglass matting is between mold 40 and the counter mold. Force is applied to compress the fiberglass matting and resin, which expels air from the matting. While the vacuum-setting process described with reference to FIG. 2 can achieve a maximum compressive force of atmospheric pressure, which is about 15 pounds per square inch (psi), the force applied in using a counter mold can be any desired force. The force may typically range between about 15 and about 200 psi, but is preferably between about 75 and 125 psi and is more preferably about 100 psi.

Pyrotechnic launch tube 10 is lightweight, non-conductive electrically, which is desirable to prevent accidental discharge, non-corrosive, non-metallic and watertight. As explosive forces are encountered by bottom member 30 during discharge of the pyrotechnics, forces are transmitted radially through bottom member 30 and into tube 12, where the forces are contained by a reactive compressive force of tube 12, although an analysis of forces is not part of this invention.

An FRP pyrotechnic launch tube is thus provided, which has a bottom engaged with the inside wall 18 of tube 12 at groove 22. Surface 30*a* is preferably convex, although it may be flat or even concave. Bottom 30 is thus formed with an outer circumferential edge 30*b*, which engages a shoulder 22*a* formed by groove 22 in inside wall 18 of tube 12. Bottom member 30 is thus firmly engaged with tube 12 with edge 30*b* engaged with shoulder 22*a*.

The foregoing disclosure and description of the invention are illustrative and explanatory thereof, and various changes in the details of the illustrated apparatus and construction and method of operation may be made without departing from the spirit of the invention.

What is claimed is:

1. A method for making a fiberglass reinforced polymer (FRP) pyrotechnic launch tube, comprising the steps of:

providing an FRP tube having an upper end, a lower end, an inside wall and a circumferential groove in the inside wall near the lower end; and engaging a bottom piece in the groove, wherein the step of engaging the bottom piece comprises molding FRP.

2. The method of claim 1, wherein the molding step includes:

sealing a mold with the inside wall proximate to the groove;

laying fiberglass matting having a resin coating onto the mold;

placing a portion of the fiberglass matting within the groove for engagement with the tube; and curing the resin.

3. The method of claim 2, further comprising vacuum setting the fiberglass matting before the curing step.

4. The method of claim 3, wherein the step of vacuum setting comprises placing a porous material over the fiberglass matting so that the matting is between the mold and the porous material;

scaling a nonporous sheet over the fiberglass matting; and drawing a vacuum on the fiberglass matting so that the nonporous material collapses onto the fiberglass matting and forces the fiberglass matting into the groove.

5. The method of claim 2, further comprising compressing the fiberglass matting between the mold and a counter mold before the curing step.

6. The method of claim 2, wherein the curing step includes applying heat.

7. A method for making a fiberglass reinforced polymer (FRP) pyrotechnic launch tube, comprising the steps of:

providing an FRP tube having an upper end, a lower end, an inside wall and a circumferential groove in the inside wall near the lower end; and engaging a bottom piece in the groove, wherein the step of engaging the bottom piece comprises:

providing a flexible, disc-shaped element;

pressing the disc-shaped element into the tube; and allowing the disc-shaped element to expand into the groove.

8. A method for making a fiberglass reinforced polymer (FRP) pyrotechnic launch tube, comprising the steps of:

providing an FRP tube having an upper end, a lower end, an inside wall and a circumferential groove in the inside wall near the lower end; and engaging a bottom piece in the groove, wherein the bottom piece has a convex surface, and the convex surface and the inside wall of the tube define a chamber for receiving pyrotechnics.

9. The method of claim 1, wherein the mold has a concave surface, which forms the bottom piece with a convex surface, wherein the convex surface of the bottom piece and the inside wall of the tube define a chamber for receiving pyrotechnics.

10. A pyrotechnic launch tube made according to a method, comprising the steps of:

providing a fiberglass reinforced polymer (FRP) tube having an upper end, a lower end, an inside wall and a circumferential groove in the inside wall near the lower end; and engaging a bottom piece in the groove.

11. A method for making a fiberglass reinforced polymer (FRP) pyrotechnic launch tube, comprising:

forming an FRP tube having an inside wall and upper and lower ends;

forming a groove in the inner wall about the circumference of the tube;

placing a mold inside the tube in sealed engagement with the inside wall adjacent to the groove;

laying a resin-coated fiberglass matting on the mold and in the groove;

placing a porous material on the fiberglass matting;

forming a sealed bag over the lower end of the tube;

evacuating the bag for pressing the fiberglass matting into the groove and onto the mold; and curing the resin.

12. The method of claim 11, wherein the mold has a concave surface so that a bottom is formed having a dome-shaped surface, wherein the dome-shaped surface and the inside wall define a chamber for receiving pyrotechnics.

13. The method of claim 11, wherein the groove is formed as the tube is formed.

14. The method of claim 11, wherein the groove is cut into the tube after the tube is formed.

15. A method for making a fiberglass reinforced polymer (FRP) pyrotechnic launch tube, comprising:

forming an FRP tube having an inside wall and upper and lower ends;

forming a groove in the inner wall about the circumference of the tube;

placing a mold inside the tube in sealed engagement with the inside wall adjacent to the groove;

laying a resin-coated fiberglass matting on the mold and in the groove;

placing a counter mold on the fiberglass matting;

compressing the fiberglass matting between the mold and the counter mold; and curing the resin.

16. The method of claim 15, wherein the mold has a concave surface so that a bottom is formed having a dome-shaped surface, wherein the dome-shaped surface and the inside wall define a chamber for receiving pyrotechnics.

17. The method of claim 16, wherein the counter mold has a convex surface sized to matingly engage the concave surface of the mold so the bottom has a relatively uniform thickness.

18. A fiberglass reinforced polymer (FRP) pyrotechnic launch tube, comprising:

an FRP having an outside wall, an upper end, a lower end, and a groove on the inside wall around the inner circumference of the tube; and a bottom protruding into the groove, wherein the bottom has a convex surface, wherein the convex surface of the bottom and the inside wall of the tube form a chamber for receiving pyrotechnics.

19. The pyrotechnic launch tube of claim 18, wherein the convex surface has the shape of a dome.

20. A fiberglass reinforced polymer (FRP) pyrotechnic launch tube, comprising:

an FRP having an outside wall, an upper end, a lower end, and a groove on the inside wall around the inner circumference of the tube; and a bottom protruding into the groove, wherein the bottom is a piece of FRP molded in place so as to mechanically engage the tube where the bottom protrudes into the groove, the bottom having a hemispherical shape extending toward the upper end so that as pyrotechnics explode within the tube, the bottom is pressed into deeper engagement with the tube at the groove.

* * * * *